United States Patent [19]

Mears

[11] Patent Number: 4,919,365

[45] Date of Patent: Apr. 24, 1990

[54] AIRFOIL

[76] Inventor: Arthur W. Mears, 5212 Lone Tree Dr., Loveland, Colo. 80537

[21] Appl. No.: 202,678

[22] Filed: Jun. 6, 1988

[51] Int. Cl.[5] ..... B64C 31/06

[52] U.S. Cl. ..... 244/153 R; 446/220; 244/33; 116/210

[58] Field of Search ..... 244/153 R, 153 A, 154; 446/220, 225, 224, 226; 116/210, DIG. 8, DIG. 9

[56] References Cited

U.S. PATENT DOCUMENTS

| | | | |
|---|---|---|---|
| 3,620,486 | 11/1971 | Charpentier et al. | 244/153 R |
| 4,026,504 | 5/1977 | Christoffel, Jr. | 244/153 R |
| 4,125,233 | 11/1978 | Winker et al. | 446/225 |
| 4,586,910 | 5/1986 | Buchanan | 446/224 |
| 4,693,695 | 9/1987 | Cheng | 446/220 |
| 4,722,498 | 2/1988 | Cameron | 244/153 R |

FOREIGN PATENT DOCUMENTS

| | | | |
|---|---|---|---|
| 0170181 | 2/1986 | European Pat. Off. | 446/224 |

OTHER PUBLICATIONS

David Pelham, The Penguin Book of Kites, 1976, pp. 57 and 87.

*Primary Examiner*—Joseph F. Peters, Jr.
*Assistant Examiner*—Anne Sartelle
*Attorney, Agent, or Firm*—H. Kenneth Johnston, II

[57] ABSTRACT

An airfoil which is capable of being inflated either by using a lighter-than-air or other gas from a gas cylinder or by oral inflation comprising an aerodynamically shaped inflatable portion, a flexible keel and two flexible winglets, one spaced on each side of the keel equipped with a tether system for providing the airfoil aerodynamic stability and maneuverability in flight.

6 Claims, 1 Drawing Sheet

AIRFOIL

OBJECTIVIES OF THE INVENTION

A broad objective of the invention is to provide a novel airfoil capable of being inflated orally or with lighter-than-air gas which has improved aerodynamic stability and manuverability during high wind or adverse weather conditions.

Another objective of the invention is to provide a locator device which can be deployed by a lost or injured individual even under adverse conditions.

Another objective of the invention is to provide an airfoil that is extremely simple in design and construction and inexpensive so that the device may be discarded after a single use.

Still another objective of the invention is to provide an inflatable toy which can be flown even by children with manuverability greater than that of a sport kite.

BACKGROUND OF THE INVENTION

There are numerous inflatable devices for providing location information; however, these devices are cumbersome, are not simple to operate and will not fly under windy conditions and in fact are driven to the gound in high wind conditions and otherwise have no manuverability.

MacFadden, U.S. Pat. No. 3,395,877, claims a aerodynamically stable site marker balloon capable of being tethered under adverse flight condition. However, although MacFadden may fly where the spherical balloon will not, MacFadden will not fly and in fact will be driven to the ground in high wind conditions. The present airfoil invention will fly in adverse weather as well as high wind conditions and is manuverabe allowing it to be flown by an individual for the enjoyment of flying it.

DESCRIPTION OF THE DRAWINGS

Refering more particularly to the accompanying drawings, which are for illustrative purposes only.

DESCRIPTION OF THE PREFERRED EMBODIMENT

Figure 1:
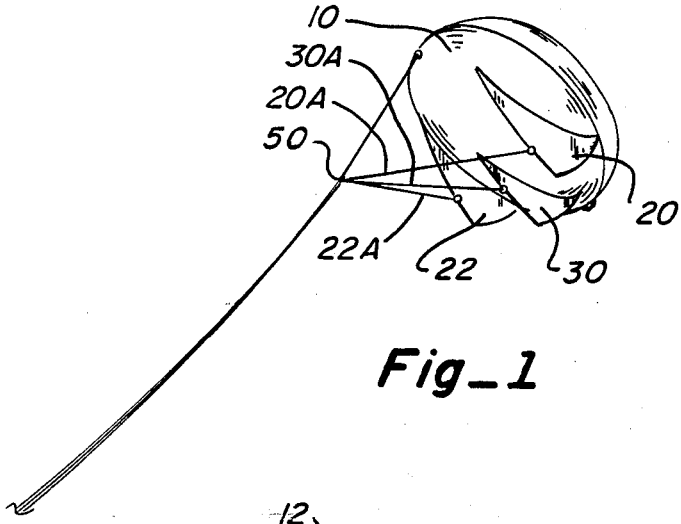
FIG. 1 is a perspective view of the airfoil in flight.
Figure 2:
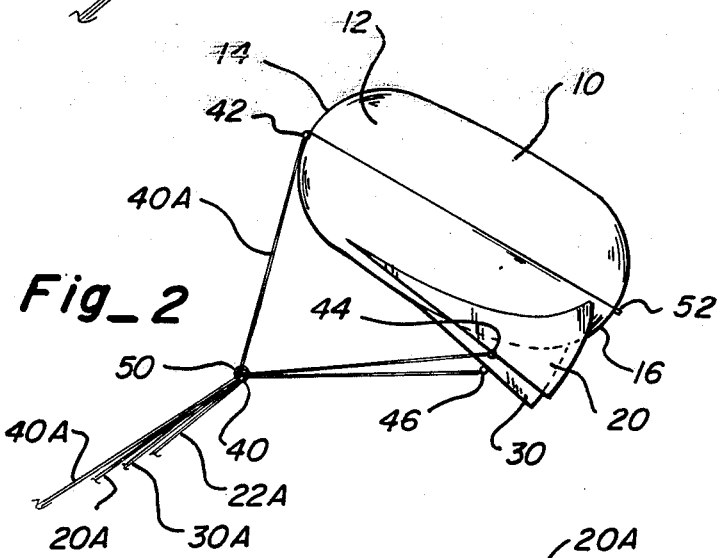
FIG. 2 is a side perspective view of the airfoil and tether system.
Figure 3:
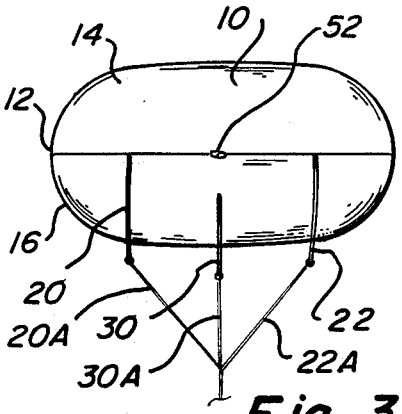
FIG. 3 is a perspective rear view of the airfoil.

Refering more particularly to the drawings, there is shown an airfoil 10 in flight in FIG. 1. As illustrated in FIG. 2 and FIG. 3, airfoil 10 is an inflatable envelope 12 having a upper portion 14 and a lower portion 16 capable of being inflated through one way valve 52. Airfoil 10 is affixed at the lower portion 16 with winglets 20 and 22 and keel 30 which provide the maneuverability to the airfoil 10.

Figure 4:
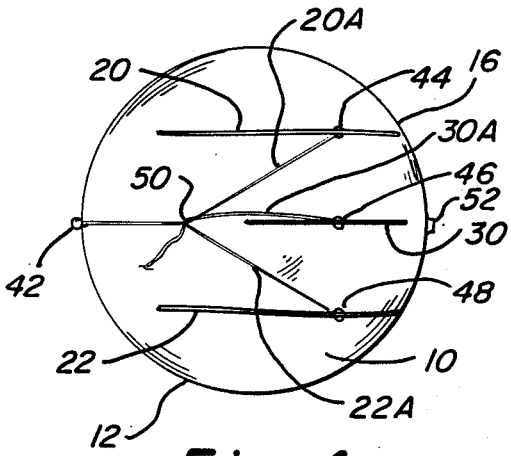
FIG. 4 is a perspective bottom view of the airfoil.

Airfoil 10 is tethered at approximately the front center of the inflatable envelope 12 at point 42 where upper portion 14 and lower portion 16 communicate with each other and to the keel 30 at point 46, to the left winglet 20 at point 44 and the right winglet 22 at point 48 of the lower portion 16 of the inflatable envelope 12 as shown in FIG. 2 and FIG. 4. The tether lines 20A, 22A, 30A, and 40A are affixed by conventional techniques to airfoil 10 and tether lines 20A, 22A, and 30A pass through tether guide 50 which is attached to tether line 40A at point 40 to the individual on the ground in order that he/she may control the flight of airfoil 10. Although tether guide 50 is not required, it aids in the ease of control of the tether lines 20A, 22A, and 30A, and the flight of airfoil 10.

Envelope 12 is made by affixing upper portion 14 and lower portion 16 which are basically flat circular or disc shaped elements in a conventional means such as heat sealing. One way valve 52 is affixed at the same time that upper portion 14 and lower portion 16 are fabricated together so that the resultant envelope 12 is basically air tight.

In operation airfoil 10 is manuvered by increasing the tension on a tether line such as tether line 20A attached to winglet 20 at point 44. Airfoil 10 will then dive to the left and similarly when the tension is increased on the tether line 22A attached to winglet 22 at point 48, the airfoil 10 will dive to the right side. Upon release of the tension or equalizing the tension on the winglets 20 or 22, the airfoil 10 will climb to the original flight height prior to effecting the manuvering of the airfoil 10. As shown in FIG. 2, by increasing the tension on tether line 30A which is attached to keel 30 at point 46, the airfoil 10 will be placed in an increased climb mode.

Airfoil 10 may be made of a metalized polymer material which would be highly visible and detectable by microwave. Although not necessary, Airfoil 10 may be equipted with a metalized tail to provide additional visibility and detectability.

Althought it is understood that the envelope may be made by joining different shapes, such as an oblong shape similar to a para sail, the circular envelope is the preferred embodiment because of the requirement of less gas for filling the envelopment.

The invention and its attendant advantages will be understood from the foregoing description; and it will be apparent that various changes may be made in the form, construction and arrangement of the parts of the invention without departing from the spirit and scope thereof, or sacrificing its material advantages, the arrangments hereinbefore described being merely by way of example; and I do not wish to be restricted to the specific forms or uses mentioned, except as defined in the accompanying claims.

What is claimed is:

1. A lighter-than-air inflatable device comprising:

an aerodynamically shaped envelope having a horizontal and vertical axis and having a circular cross-section taken along the horizontal axis; said envelope having a upper portion and a lower portion communicating with each other in a manner that said envelope will retain a gas and its aerodynamic shape upon being inflated through a inflation means;

a guidance means mounted rearwardly on and extending below said lower portion running approximately parallel to the longitudinal axis of said envelope;

a tether line means secured to both said envelope and said guidence means for tethering said envelope and providing manuverability input to said envelope.

2. A lighter-than-air inflatable device as setforth in claim 1 wherein said inflation means is a one way valve capable of passing air into said envelope by oral means.

3. A lighter-than-air inflatable device as setforth in claim 1 wherein said inflation means is a one way valve capable of passing gas into said envelope from a compressed gas cylinder.

4. A lighter-than-air inflatable device as setforth in claim 1 wherein said guidance means consists of two winglets and keel with said keel affixed approximately centered between said winglets for additional stability.

5. A lighter-than-air inflatable device as setforth in claim 1 wherein said tether line means consists of tether lines and a tether guide for guidance and anchoring said inflatable device.

6. A lighter-than-air inflatable device as setforth in claim 1 wherein said envelope is fabricated from a pair of circular shaped elements.

* * * * *